United States Patent [19]

Rovin

[11] Patent Number: 4,669,718

[45] Date of Patent: Jun. 2, 1987

[54] BI-DIRECTIONAL ACTUATOR

[76] Inventor: Herman Rovin, 101 Bromsgrove Dr., Greenville, S.C. 29609

[21] Appl. No.: 829,757

[22] Filed: Feb. 14, 1986

[51] Int. Cl.[4] ..... B65H 7/02

[52] U.S. Cl. ..... 271/227; 271/250; 271/228; 112/121.12; 226/21; 74/479

[58] Field of Search ..... 271/226, 227, 242, 245–247, 271/234–236, 248, 250–252, 264, 266, 228, 254; 112/121.12; 74/479; 226/21–23

[56] References Cited

U.S. PATENT DOCUMENTS 4,411,418 10/1983 Poehlein ..... 271/236
4,607,835 8/1986 Wilson et al. ..... 271/251

FOREIGN PATENT DOCUMENTS 241122 10/1925 United Kingdom ..... 271/251
1154964 6/1969 United Kingdom ..... 271/251

*Primary Examiner*—H. Grant Skaggs
*Attorney, Agent, or Firm*—Mandeville and Schweitzer

[57] ABSTRACT

A bi-directional actuator is disclosed which comprises a frame, rotatable about a principal longitudinal axis. The frame mounts two or more partially spherical drive elements. The centers of the partially spherical elements are located on the longitudinal axis of the frame, and the elements are mounted for rotation about individual axes which are perpendicular to but intersect with the longitudinal axes. The individual axes of the respective drive elements are also angularly oriented with respect to each other. The cross sectional outline of the frame is contained within a cylindrical envelope of less diameter than the spheres. Driving devices, such as a belt, are provided to engage at least one of the drive elements in any rotary position of the frame. Directly opposite the belt or other driving device, the driven element or elements engages a material to be driven, typically a piece of fabric. Rotation of the drive elements by the belt provides for material advancement along a first (longitudinal) axis, rotation of the frame about its own axis serves, through the spherically contoured drive elements, to advance the material along a second axis, at right angles to the first.

9 Claims, 5 Drawing Figures

BI-DIRECTIONAL ACTUATOR

BACKGROUND AND SUMMARY OF THE INVENTION

The invention is directed to a machanism for guiding and advancing a sheet material. It is particularly applicable for, although not necessarily limited to, the feeding and guiding of fabrics, and for purposes of illustration the invention will be described in the context of a device for feeding and guiding of fabrics.

In the processing of fabrics into garments, there is a wide variety of operations that require the simultaneous advancement and positioning of the fabric. Perhaps the most common such operation is in the hemming of the fabric along its edges. In order to perform this type of operation, as well as many others, with any degree of automation, it is necessary to be able to sense the position of the fabric edge as the fabric is advanced, and to manipulate the fabric laterally, while it is being advanced, in order to maintain the fabric edge in a predetermined alignment. Many devices have been proposed in the prior art for this general purpose. Such prior devices have not, however, been altogether satisfactory for one or more reasons of excessive cost, inadequate performance, excessive size, lack of reliability, etc. The present invention is directed to a uniquely simple, compact, low cost mechanism which engages the fabric surface and is functional to drive the fabric simultaneously in each of the two principal rectilinear axes, thus serving to advance the fabric longitudinally while effecting any necessary lateral adjustment of the fabric edge.

In accordance with the invention, a drive mechanism is provided which comprises a plurality of spherically contoured drive elemtents, which are arranged to drivingly engage one surface of a fabric or other sheet material to be controlled and which are driven controllably to advance the material in a longitudinal direction. Uniquely, the spherically contoured drive elements are mounted to be bodily rotated about an axis extending in the longitudinal or material advancing direction. Means are provided for controllably rotating the spherical drive elements about said longitudinal axis simultaneously with the forward-driving rotation of the drive elements. The arrangement is such that the spherically contoured drive elements serve to drive the fabric forwardly or rearwardly, in response to rotation of the drive elements about their principal rotational axes, while the material is driven laterally, in one direction or the other, by bodily rotation of the drive elements about said longitudinal axis.

In one of its simplest forms, the mechanism of the invention comprises a pair of spherically contoured, rotatable drive elements, which are mounted in a rotatable frame structure. The rotatable frame structure is supported for rotation about a longitudinal axis, in relation to the direction of material movement. The two spherically contoured drive elements are mounted for rotation about axes at right angles to the longitudinal axis of rotation of the frame structure. In addition, where two drive elements are employed, their respective axes of rotation are oriented at 90° with respect to each other. If more than two drive elements are utilized, their respective axes of rotation are displaced angularly in a uniform manner according to the number of drive elements (e.g., three drive elements would have their axes displaced at 60°).

Pursuant to another aspect of the invention, the orientation and dimensioning of the spherically contoured drive elements is such that, in any rotary position of the rotatable frame structure, at least one of the spherically contoured drive elements will be in driving contact with the material to be manipulated. Thus, in a mechanism utilizing two such driving elements, the spherically contoured surface of a drive element, in the plane of its rotational axis, will subtend and angle of at least about 90° from the center of the sphere, located symmetrically with respect to the axis of rotation of the drive element. Thus, each drive element is in the form of a sphere, mounted on a shaft for rotation about the axis of that shaft and truncated at its opposite "poles". The extent of truncation of these spherically contoured drive elements must be sufficient to enable rotational mounting thereof from within the confines of the projected spherical contour. At the same time, the maximum extent of truncation is limited by the requirement that in any rotary position of the mounting frame, at least one drive element will have surface contact with the material to be manipulated.

In accordance with another aspect of the invention, a unique form of drive mechanism is provided for the spherically contoured drive elements such that the speed of rotation of the drive elements is varied automatically with any change in the effective radius of the surface portion of a drive element actually engaging the material to be manipulated. In this respect, as the spherically contoured driving elements are rotated about the longitudinal axis of their supporting frame, in order to manipulate the material laterally, the radius of the surface areas of the drive elements having operative contact with the material will vary from a maximum, at the center of the spherically contoured element engages the fabric, to a minimum, where the spherical element engages the fabric near the truncated side of the element. Since the effective radius of the spherical element with respect to is own axis of rotation decreases toward the "poles", it is necessary to correspondingly increase the speed of rotation of the drive element in order to maintain a uniform forward advancing speed. In the mechanism of the invention. this is accomplished by driving the spherically contoured driving elements through the medium of a moving flexible belt, having a working section which is parallel to the plane of the material to be manipulated and which is driven in a direction opposite to the direction of longitudinal advancement of the material but at the desired speed of such advancement. The working section of the belt engages the spherically contoured drive elements in a surface area which is directly opposite the area in which the drive elements engage the material itself. Accordingly, the drive belt will at all times engage the spherically contoured elements at the same effective radius as the material to be manipulated. Exclusive of any slippage, the material to be manipulated will thus have the same forward speed as the working section of the belt, even though the rotational speed of the spherically contoured drive elements may vary in accordance with the rotational positioning of those drive elements about the longitudinal axis of the supporting frame.

For a more complete understanding of the above and other features and advantages of the invention, reference should be made to the following detailed description of a preferred embodiment, and to the accompanying drawings.

DESCRIPTION OF A PREFERRED EMBODIMENT OF THE INVENTION

Figure 1:
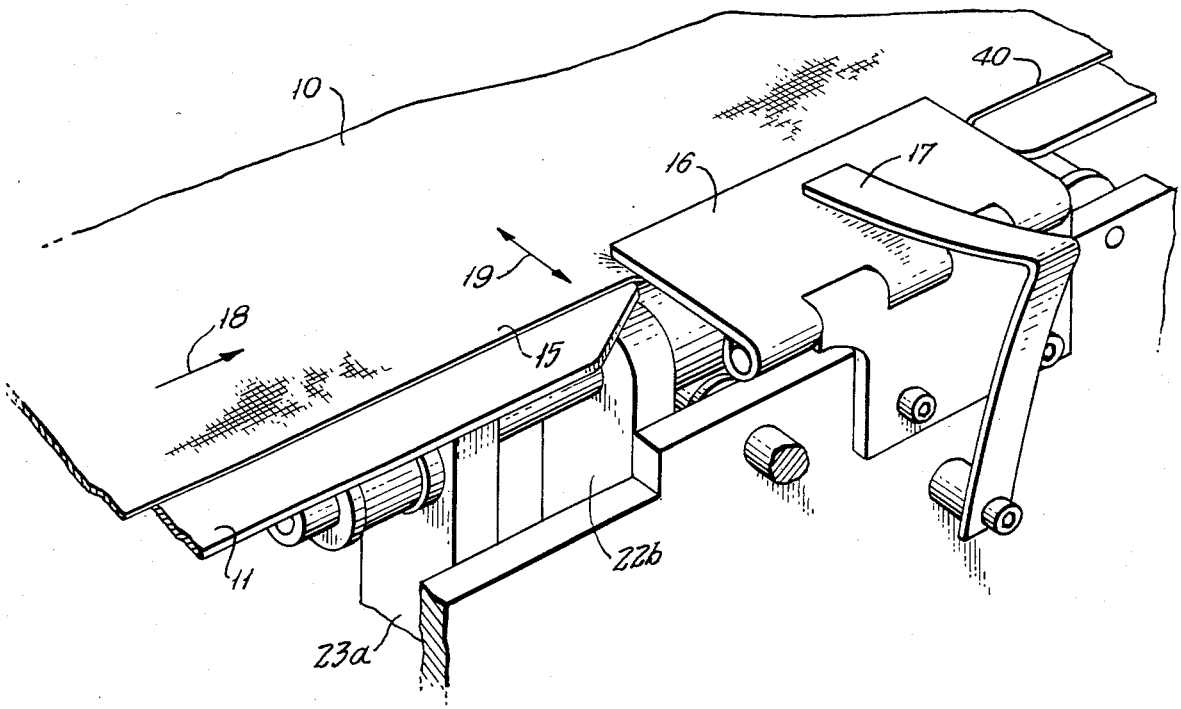
FIG. 1 is a fragmentary, perspective illustration of a material manipulating mechanism, such as might be employed in connection with a sewing machine, utilizing a manipulating mechanism according to the invention.
Figure 2:
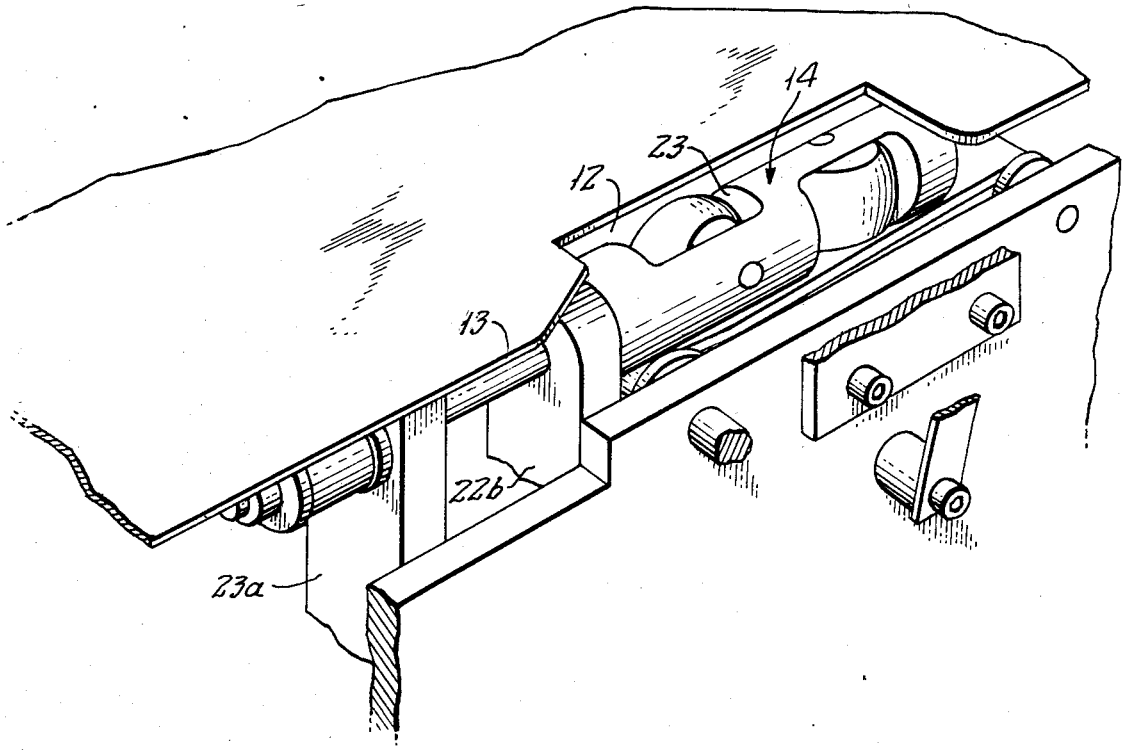
FIG. 2 is a perspective view, similar to FIG. 1, with parts broken away to illustrate the positioning of the drive mechanism directly underneath a supporting table for the material to be manipulated.
Figure 3:
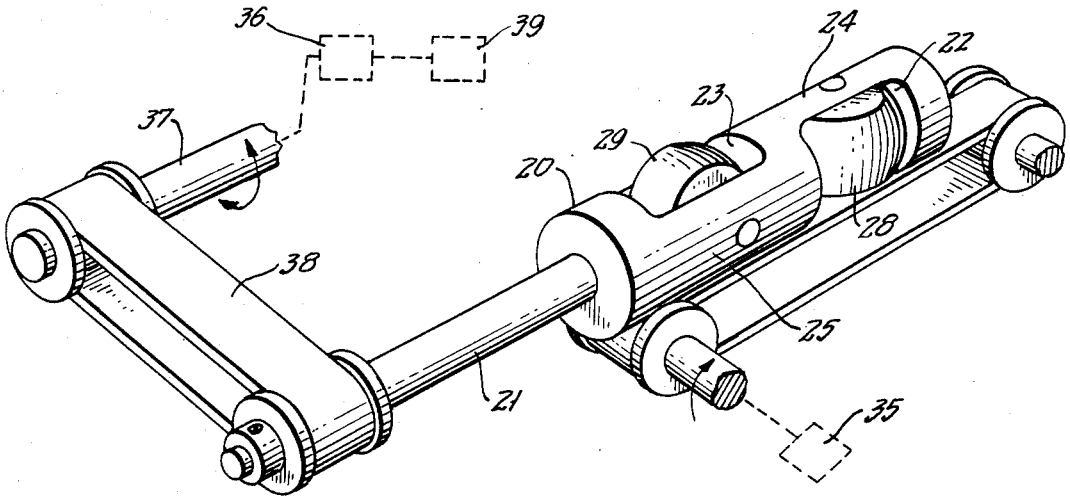
FIG. 3 is a perspective illustration of the bare essential elements of the bi-directional actuator mechanism of the invention.
Figure 4:
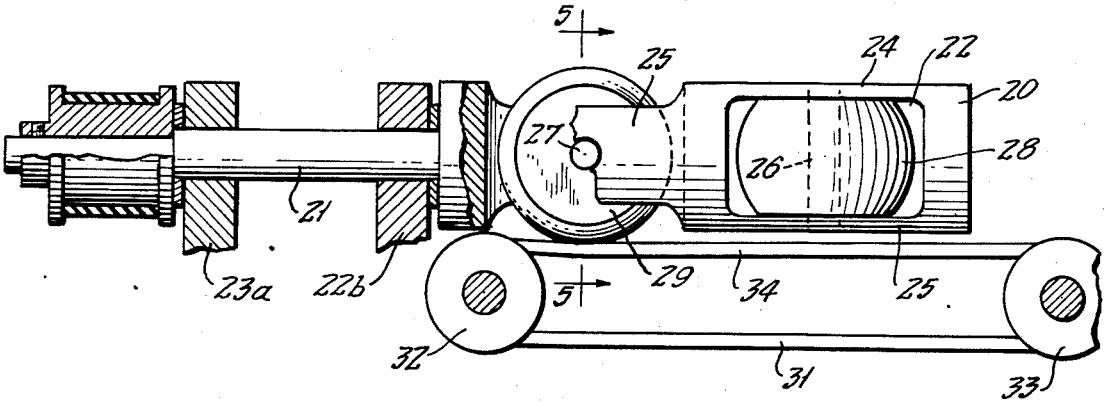
FIG. 4 is a side elevational view of the mechanism of FIG. 3.

Referring now to the drawings, the reference numeral 10 designates generally a flat sheet-like material, such as a typical fabric, which is being manipulated. In the illustrated arrangement, the fabric 10 is mounted on the work table 11 of a sewing machine, for example, the mechnism of which is not shown. The work table is provided with a cut-out gap 12 near one edge 13. Directly under that gap is mounted the drive portion 14 of a bi-directional actuator device according to the invention. In the illustrated arrangement, an edge 15 of the fabric is arranged to pass over the area of the drive mechanism 14, and is held in pressure contact therewith by means of pressure plate 16, urged downwardly by a spring arm 17. The mounting of the actuator unit 14 is such that the fabric is engaged thereby in the plane of the top surface of the working table 11. In the mechanism of FIG. 1, the directional arrow 18 indicates the longitudinal direction with respect to the basic machine, while the directional arrow 19 indicates a lateral or transverse direction. Since the actuator of the invention is entirely bi-directional, reference to these directions are primarily for convenience in understanding the mechanism since, in theory at least, the actuator could be effectively oriented in any direction underneath the working table 11.

In accordance with the invention, a frame or cage element 20 is mounted for rotation about the longitudinal axis, by means of the shaft 21 journalled in bearing posts 22, 23, secured to the frame of the sewing machine or other principal apparatus. In one of its more simplified forms, the frame 20 may be in the form of a simple cylinder, somewhat eleongated in the direction of its axis, and having its axis coincident with that of its supporting shaft 21.

In the illustrated mechanism, the cylindrical frame element 20 is provided with front and rear transverse openings 22, 23, the length of which, in the longitudinal direction of the shaft 21, is somewhat greater than the diameter of the cylinder 20, and the width of which is slightly less than the diameter of the cylinder, leaving relatively narrow side panels 24, 25 at each side.

Mounted in each of the through openings 22, 23, by means of shafts 26, 27 are spherically contoured drive elements 28, 29. Pursuant to the invention, the spherically contoured drive elements 28, 29 are in the form of truncated spheres. Considering the respective shafts 26, 27 as defining polar axes, the drive elements 28, 29 are symmetrically truncated at each of their "poles". The diameter of the spherically contoured elements is slightly greater than the diameter of the frame element 20, assuming the latter to be cylindrical in form. If the frame 20 is in a form other than cylindrical, it is necessary that its elements be wholly contained within a cylindrical envelope of a diameter somewhat less than that of the spherical drive elements. The arrangement is such that, as shown particularly in FIG. 5, the external surface areas 30 of the spherical drive elements project outwardly beyond the limits of the cylindrical frame element 20.

In accordance with one aspect of the invention, the spherically contoured drive elements 28, 29 are driven by means of a friction belt 31, which is trained about a pair of spaced belt sheaves 32, 33. The postioning of the sheaves 32, 33 is such as to provide an upper section 34 of the belt which is parallel to the surface of the supporting table 11 and also parallel to the axis of the shaft 21 which supports the rotary frame element 20. The upper belt section 34 is spaced below the axis of the shaft 21 a distance slightly less than the radius of the spherical elements 28, 29 so as to be able to drivingly engage the outer spherical surface portions 30 of the drive elements of the frame 20.

Figure 5:
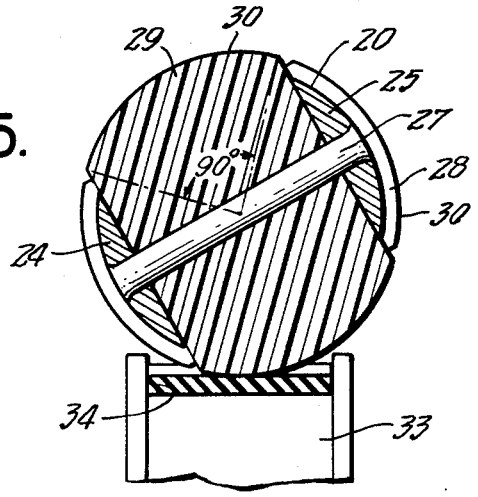
FIG. 5 is a somewhat enlarged, cross sectional view,, as taken generally on line 5—5 of FIG. 4, but with the mechanism rotationally oriented in a different position.

As will be evident in FIG. 5, depending upon the rotary position of the frame 20, the belt 34 will drivingly engage one or the other of the drive elements 28, 29. If there are only two such elements, as in the illustrated form of the invention, the thickness of each drive element, in the direction of its axis of rotation, is such that the cylindrical surface portion 30 subtends an angle of at least about 90°. If additional drive elements are provided, the thickness dimension of each element may be somewhat less, the primary consideration being that, as the frame element 20 is rotated about the axis of the shaft 21, the driving effort is transferred smoothly from one drive element to the other without a dead area. As long as the belt 31 and the material 10 have a degree of flexibility and conformablility, it may in effect, in a typical installation, be able to provide continuous driving engagement of the drive elements, even though where a small gap exists in the surface continuity of the respective drive elements (e.g., where the surfaces thereof subtend angles of slightly less than 90° in the case of a two element drive).

In the illustrated mechanism, the belt 31 is driven by a variable speed reversible motor schematically indicated at 35. The rotational orientation of the frame 20 and its drive elements 28, 29 is controlled by a separate variable speed reversible positioning motor schematically indicated at 36, which is connected to the shaft 21. In a typical installation, the shaft 21 may be connected to its drive motor 36 via a remotely positioned drive shaft 37 and connecting belt 38, as a matter of mechanical convenience. A position sensing device, schematically indicated at 39, controls the motor 36 and causes it to rotate in one direction or the other, depending upon the input to which it responds. The position sensing device 39 may be any of a wide variety of well known devices, a typical one of which may be an arrangement of photocells for detecting the position of the edge 40 of the fabric 10. Such devices are well known in the trade and need not be described further herein. The control 39 may also respond to other stimuli, such as a pre-programmed pattern.

In a typical sewing machine application, where the principal objective is to sew a seam along the edge 40 of a piece of fabric, the main drive motor 39 operates principally unidirectionally, at a predetermined, typically variable speed, while the positioning motor 36 operates reversibly, to move the edge 40 toward a predetermined guide line, whenever the edge is detected as having wandered laterally in one direction or the other. For multi-directional manipulation, however, the motor 35 may be reversibly driven in response to positioning stimuli and/or pre-programmed directions, as will be understood.

The mechanism of the invention is a simplified, mechanically compact device which provides for a highly flexible, bi-directional manipulation of sheet material, such as fabrics, wherein the same elements, i.e. the spherically contoured drive elements 28,29) operate to manipulate the fabric in both rectilinear directions, longitudinally and laterally. The longitudinal component of actuation is provided by the belt 31, which may be driven in either direction and serves to drive the fabric longitudinally an equal distance in an opposite direction through the intermediary of the driving elements 28, 29. Simultaneously, the drive elements 28, 29 may be rotated about the axis of shaft 21, in order to effect bi-directional lateral manipulation of the fabric via its driving contact with the elements 28, 29.

It should be understood, of course, that the specific form of the invention herein illustrated and described is intended to be representative only, as certain changes may be mde therein without departing from the clear teachings of the disclosure. Accordingly, reference should be made of the following appended claims in determining the full scope of the invention.

I claim:

1. A bi-directional actuator for sheet materials or the like, which comprises (a) a frame element, (b) means mounting said frame element for rotational movement about a first predetermined axis, (c) at least two frusto-spherical drive elements mounted for rotation is said frame element, (d) the centers of said drive elements being located on said first axis, (e) said drive elements being mounted for rotation about axes intersecting said first axis at right angles, (f) the individual axes of rotation of said respective drive elements being angularly displaced from each other uniformly as a function of the number of drive elements, (g) means defining a support plane of said sheet material, (h) means mounting said frame element adjacent said support plane, with said first axis parallel to said plane, whereby said frusto-spherical drive elements are generally tangent to said plane, (i) drive belt means mounted parallel to said plane and engageable with said drive elements for rotating said elements about their respective axes, (j) means for controllably driving said belt means, and (k) means for controllably rotating said frame element about said first axis.

2. A bi-directional actuator according to claim 1, further characterized by (a) said frame being contained within a cylindrical envelope coaxial with said first axis and a diameter less than said spherical elements.

3. A bi-directional actuator according to claim 2, further characterized by (a) said frusto-spherical drive elements being truncated at at least one end, (b) said frame having side portions extending lengthwise of said first axis and intersecting the axes of said drive elements adjacent the truncated ends thereof, and (c) drive element-supporting shaft means supported by said frame side portions and rotatably mounting said drive elements.

4. A bi-directional actuator according to claim 3, further characterized by (a) said drive elements being symmetrically truncated at opposite ends, (b) said shaft means projecting from both ends of said drive elements, and (c) said frame side portions extending adjacent the opposite ends of said drive elements and supporting said elements at their opposite ends.

5. A bi-directional actuator according to claim 1, further characterized by (a) said drive elements are truncated at opposite ends, (b) the remaining spherical surface portions of said drive elements subtending an angle, measured from the centers of the elements of at least approximately 180° divided by the number of drive elements.

6. A bi-directional actuator for sheet materials or the like, which comprises (a) a frame element, (b) means mounting said frame element for rotational movement about a first predetermined axis, (c) at least two frusto-spherical drive elements mounted for rotation by said frame element, (d) the centers of said drive elements being located on said first axis, (e) said drive elements being mounted for rotation about axes intersecting said first axis at right angles, (f) the individual axes of rotation of said respective drive elements being angularly displaced from each other as a function of the number of drive elements, whereby the effective spherical surface portions of said drive elements cover approximately a 360° arc about said first axis, (g) means defining a support plane for said sheet material, (h) means mounting said frame element adjacent said support plane, with said first axis parallel to said plane, whereby said frusto-spherical drive elements are generally tangent to said plane, (i) drive means adjacent to said plane and engageable with each of said drive elements for rotating said elements about their respective axes, (j) means for controllably operating said drive means, and (k) means for controllably rotating said frame element about said first axis.

7. A bi-directional actuator according to claim 6, further characterized by (a) said drive means comprising a belt extending parallel to said support plane and said first axis, (b) said belt engaging a surface portion of at least one of said drive elements in any rotary postion of said frame.

8. A bi-directional actuator according to claim 6, further characterized by (a) means resiliently engaging said sheet material or the like opposite to said drive elements for urging said material into driving engagement therewith.

9. A bi-directional actuator for sheet materials or the like, which comprises (a) a frame element, (b) means mounting said frame element for rotational movement about a first predetermined axis, (c) at least two partially spherical drive elements mounted for rotation by said frame element, (d) the centers of said drive elements being located on said first, longitudinal axis, (e) said drive elements mounted for rotation about transverse axes intersecting said first axis at right angles, (f) the individual axes of rotation of said respective drive elements being angularly displaced from each other, (g) means defining a support plane for said sheet material, (h) means mounting said frame element adjacent said support plane, with said first axis parallel to said plane, whereby said partially spherical drive elements are generally tangent to said plane, (i) drive means mounted adjacent to said plane and engageable with said drive elements for rotating said elements about their respective transverse axes, (j) means for controllably operating said drive means, and (k) means for controllably rotating said frame element about said first axis, (l) at least a portion of at least one of said drive elements being in simultaneous engagement with said sheet material and said drive means in any rotary position of said frame element.

* * * * *